US007578680B1

(12) United States Patent
Wu

(10) Patent No.: US 7,578,680 B1
(45) Date of Patent: Aug. 25, 2009

(54) CABLE ASSEMBLY HAVING INTERIOR SHIELDING STRUCTURE FOR SUPPRESSING ELECTRO-MAGNETIC INTERFERENCE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,126

(22) Filed: Jun. 24, 2008

(51) Int. Cl.
*H01R 12/00* (2006.01)

(52) U.S. Cl. ..... 439/79

(58) Field of Classification Search ..... 439/497, 439/579, 607–610, 493, 79, 83
See application file for complete search history.

(56) References Cited

U.S. PATENT DOCUMENTS

| | | | | |
|---|---|---|---|---|
| 6,431,901 | B1 | 8/2002 | Yeh | |
| 6,716,057 | B1 * | 4/2004 | Wu | 439/497 |
| 6,739,904 | B2 * | 5/2004 | Wu | 439/497 |
| 6,866,539 | B2 | 3/2005 | Chang | |
| 7,217,142 | B1 * | 5/2007 | Wu | 439/79 |
| 7,223,915 | B2 | 5/2007 | Hackman | |

* cited by examiner

*Primary Examiner*—Jean F Duverne
(74) *Attorney, Agent, or Firm*—Wei Te Chung

(57) ABSTRACT

A cable assembly includes a connector (1) having an insulated housing (10) and a plurality of contacts (100) received therein; a printed circuit board (2) having a front portion and an opposite rear portion, with the front portion thereof connected to the connector; a cable (5) coupled to the rear portion of the printed circuit board; a metallic shell (300) fastened to the printed circuit board (2) and a cover (7) enclosing the metallic shell.

5 Claims, 9 Drawing Sheets

CABLE ASSEMBLY HAVING INTERIOR SHIELDING STRUCTURE FOR SUPPRESSING ELECTRO-MAGNETIC INTERFERENCE

CROSS-REFERENCE TO RELATED APPLICATION

This application is related to U.S. patent application entitled "Cable Assembly Having Connector with Interior Printed Circuit Board Facilitating Termination", and it has the same applicant and assignee as the present invention. The disclosure of the related application is incorporated herein by reference.

FIELD OF THE INVENTION

The present invention generally relates to a cable assembly, and more particularly to a cable assembly incorporated with a connector having an internal shielding structure for suppressing electromagnetic interference.

DESCRIPTION OF PRIOR ART

Electromagnetic interference (or EMI, also called radio frequency interference or RFI) is a (usually undesirable) disturbance that affects an electrical circuit due to electromagnetic radiation emitted from an external source. The disturbance may interrupt, obstruct, or otherwise degrade or limit the effective performance of the circuit. The source may be any object, artificial or natural, that carries rapidly changing electrical currents, such as an electrical circuit, the Sun or the Northern Lights.

EMI can be induced intentionally for radio jamming, as in some forms of electronic warfare, or unintentionally, as a result of spurious emissions and responses, intermodulation products, and the like. It frequently affects the reception of AM radio in urban areas, cell phone, FM radio and television reception. It can also a data transmitting line between two electronic devices, such as a cable assembly.

A cable assembly, especially utilized for high-speed signal transmitting, has some precautions against EMI. Serial ATA connector assembly, which is widely used in recent years, equipped with anti-EMI structures in both cables and a connector. For example, U.S. Pat. No. 6,866,539 issued to Chang on Mar. 15, 2005 discloses a high frequency connector used for connecting with a high frequency transmission cable as to offer a function of transmitting signal of an electric appliance. The high frequency connector includes an insulation body with multiple terminal therein, a metal inner covering disposed at outer side of the insulation body and a jacket disposed at the outermost side of the connector. The terminals are electrically connected to the cable and the inner cover at an end thereof has a locating device for holding the cable.

A cable assembly has a different structure for anti-EMI and manufactured easily is required.

SUMMARY OF THE INVENTION

Accordingly, an object of the present invention is to provide a cable assembly having an anti-EMI configuration therein.

In order to achieve the object set forth, a cable assembly in accordance with the present invention comprises a connector including an insulated housing and a plurality of contacts received therein; a printed circuit board having a front portion and an opposite rear portion, with the front portion thereof connected to the connector; a cable coupled to the rear portion of the printed circuit board; a metallic shell fastened to the printed circuit board and a cover having a hollow portion, with the metallic shell entirely received therein.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
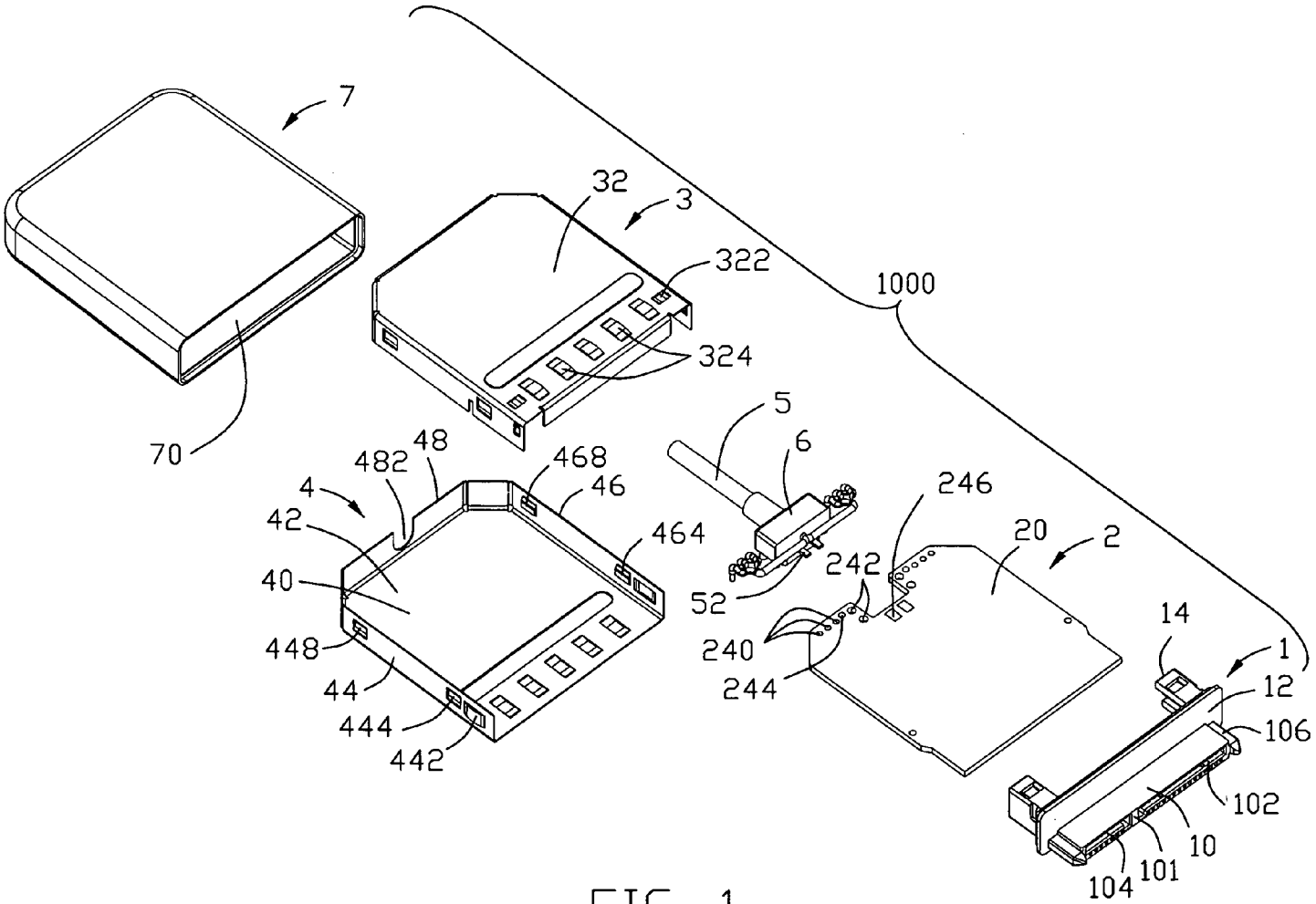
FIG. 1 is an exploded, perspective view of a first connector assembly.
Figure 2:
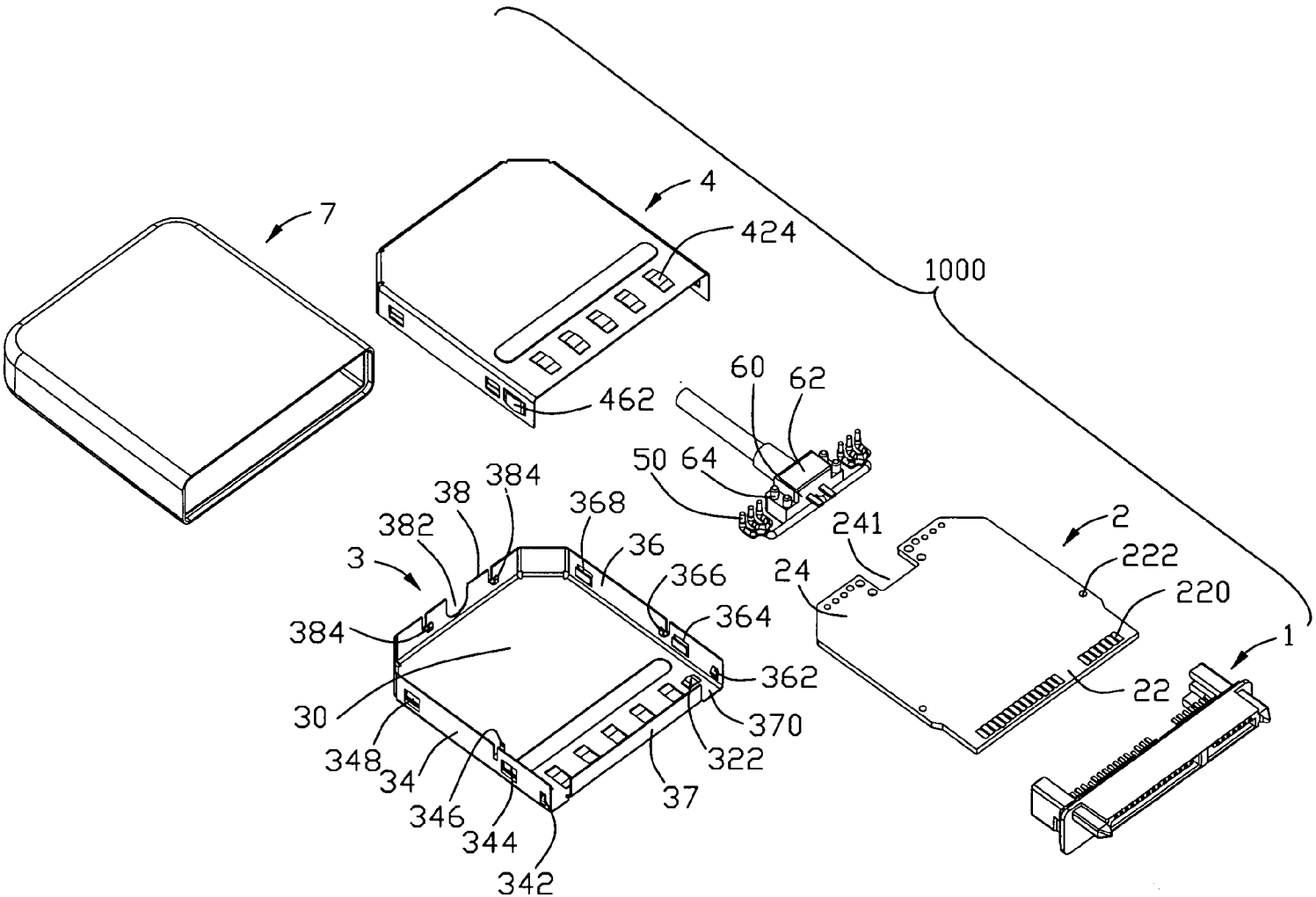
FIG. 2 is similar to FIG. 1, but viewed from another aspect.
Figure 3:
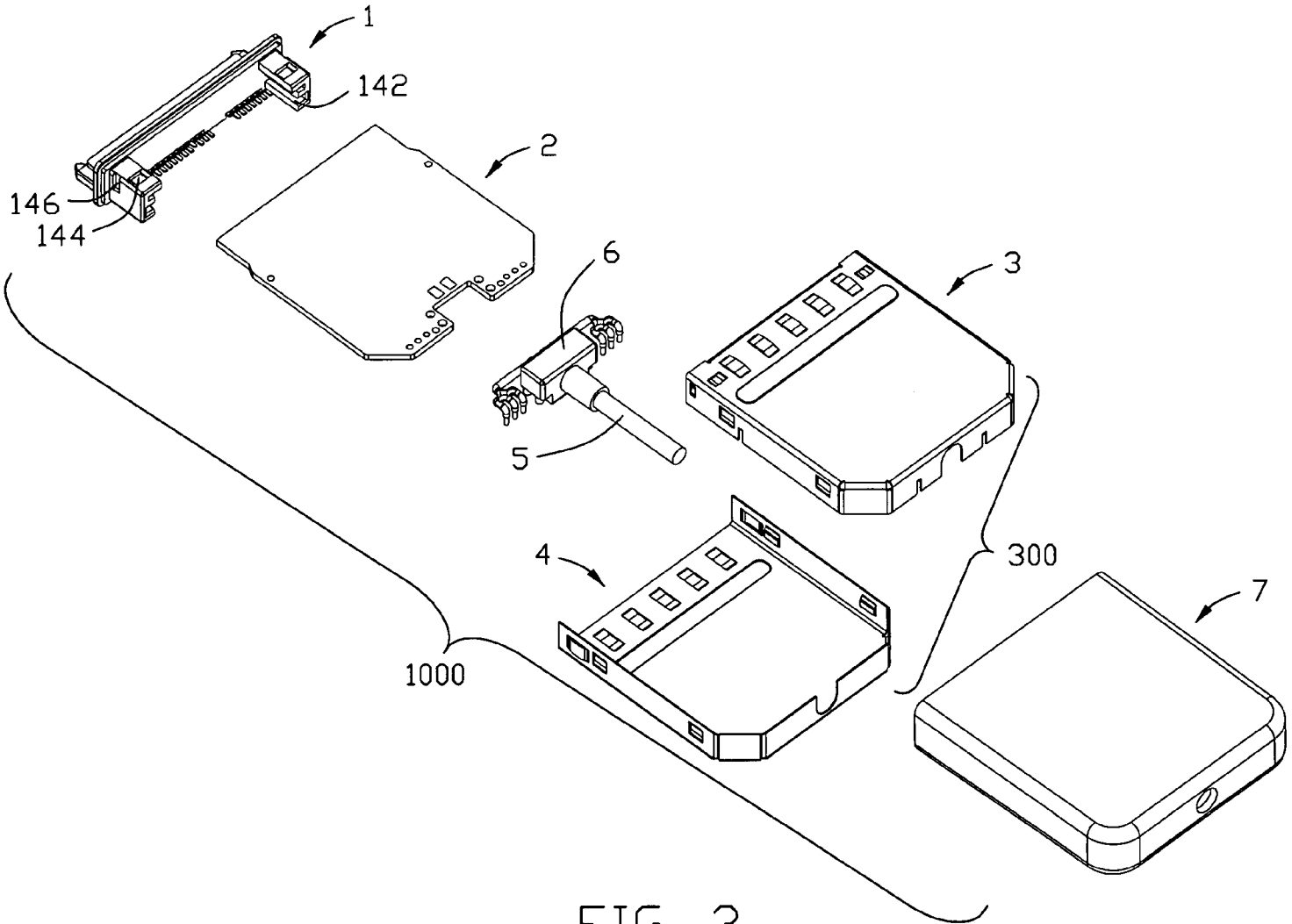
FIG. 3 is similar to FIG. 1, but viewed from other direction.
Figure 4:
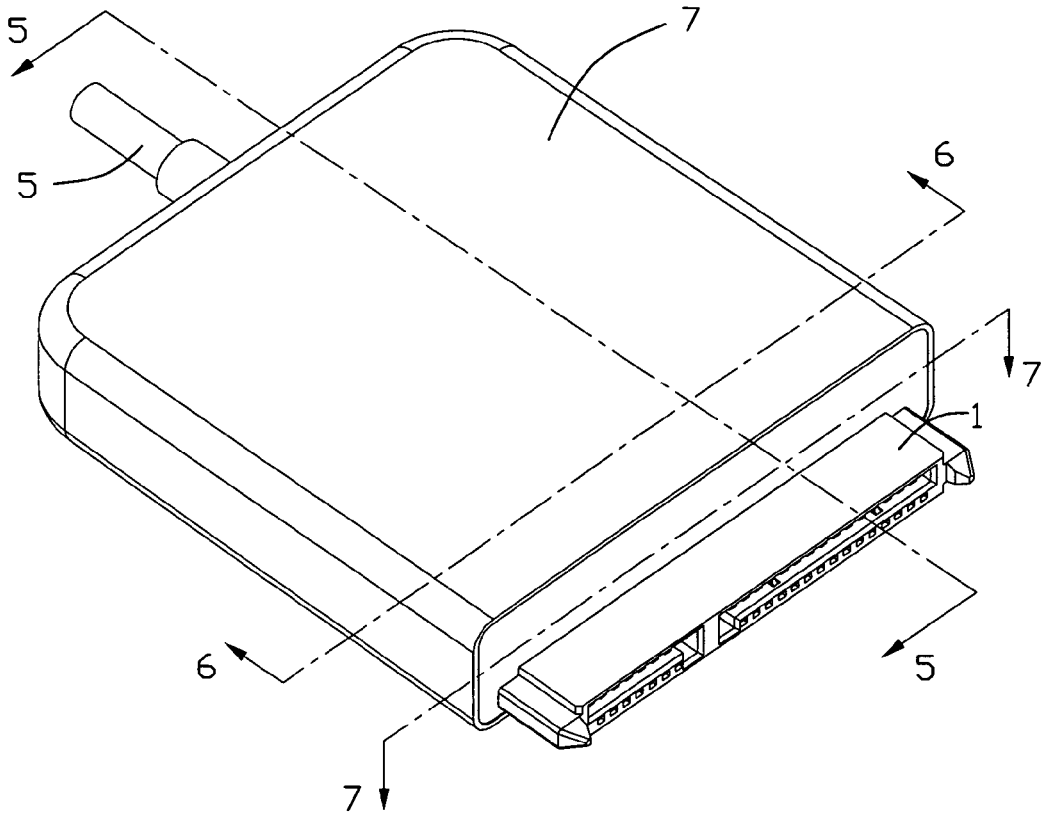
FIG. 4 is an assembled, perspective view of the first connector assembly.
Figure 5:
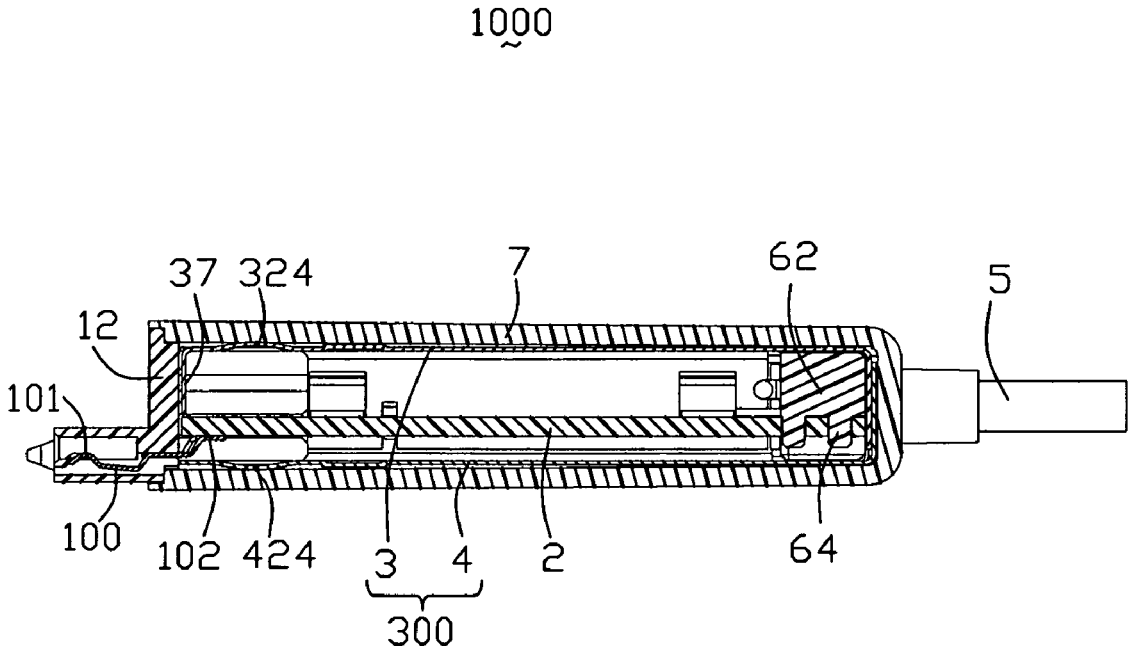
FIG. 5 is a cross-section view taken along line 5-5 of the FIG. 4.
Figure 6:
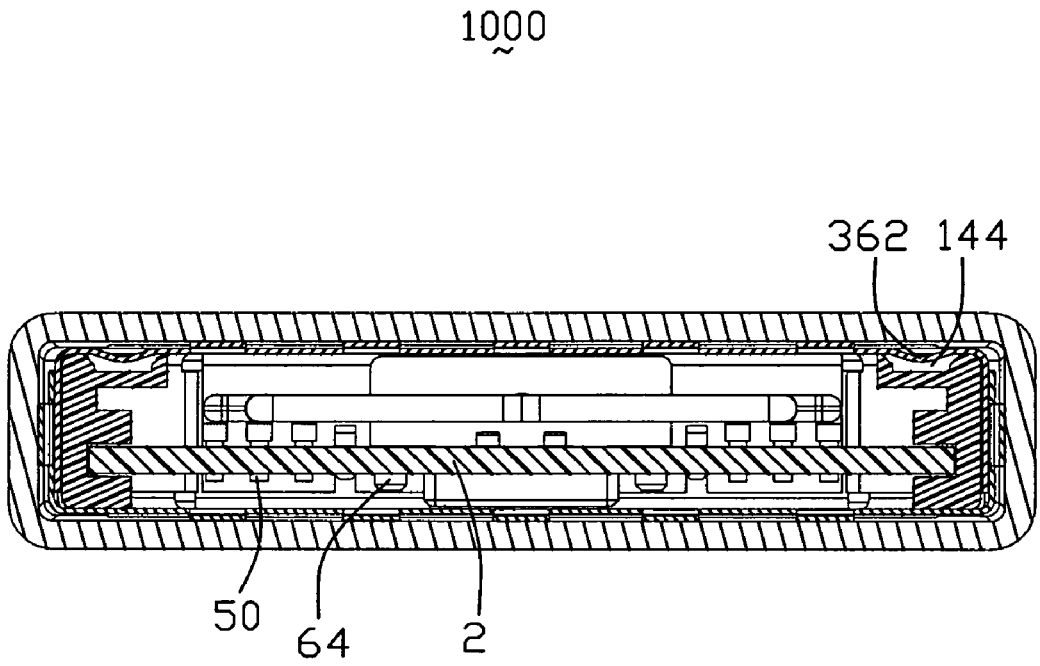
FIG. 6 is a cross-section view taken along line 6-6 of the FIG. 4.
Figure 7:
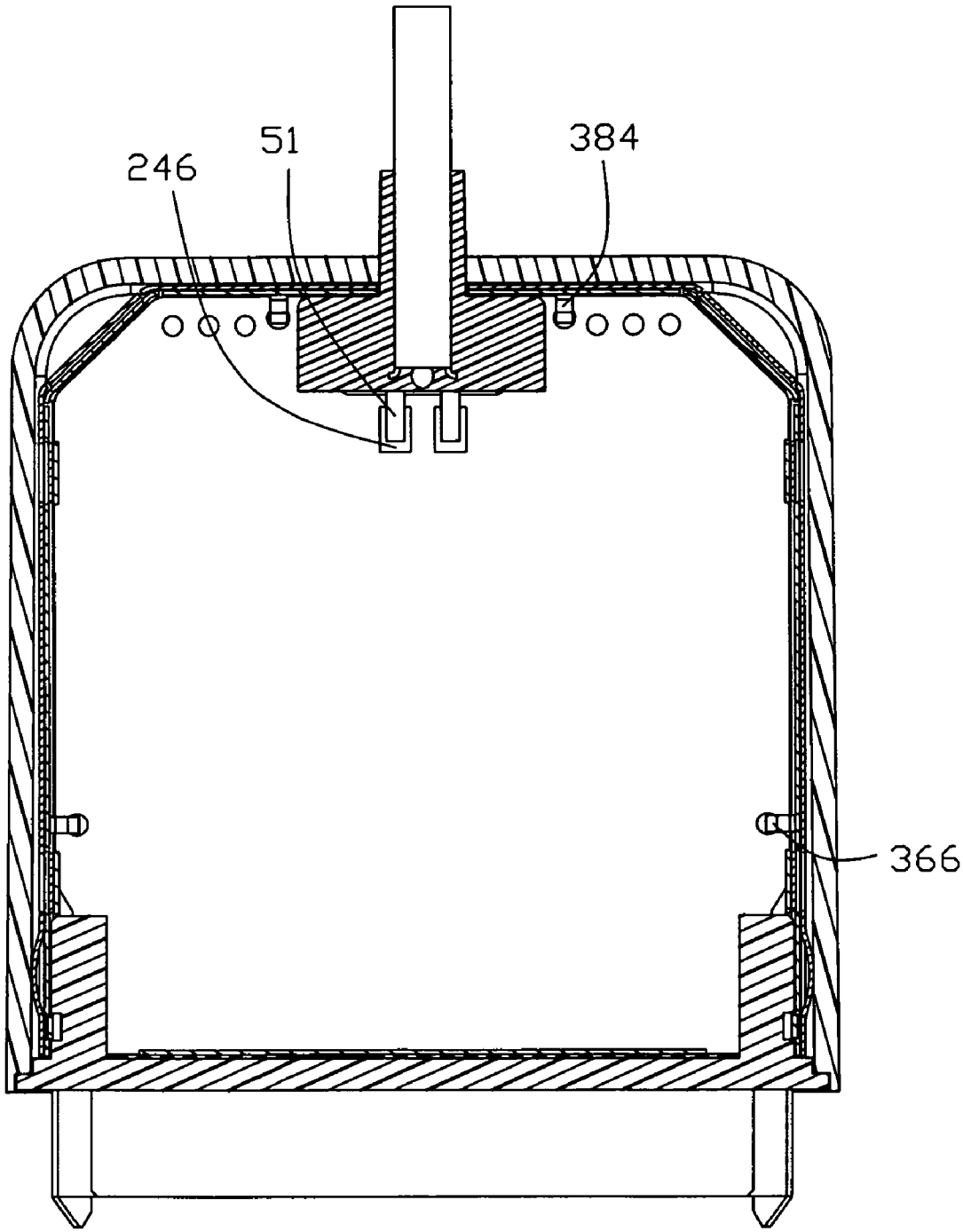
FIG. 7 is a cross-section view taken along line 7-7 of the FIG. 4.
Figure 8:
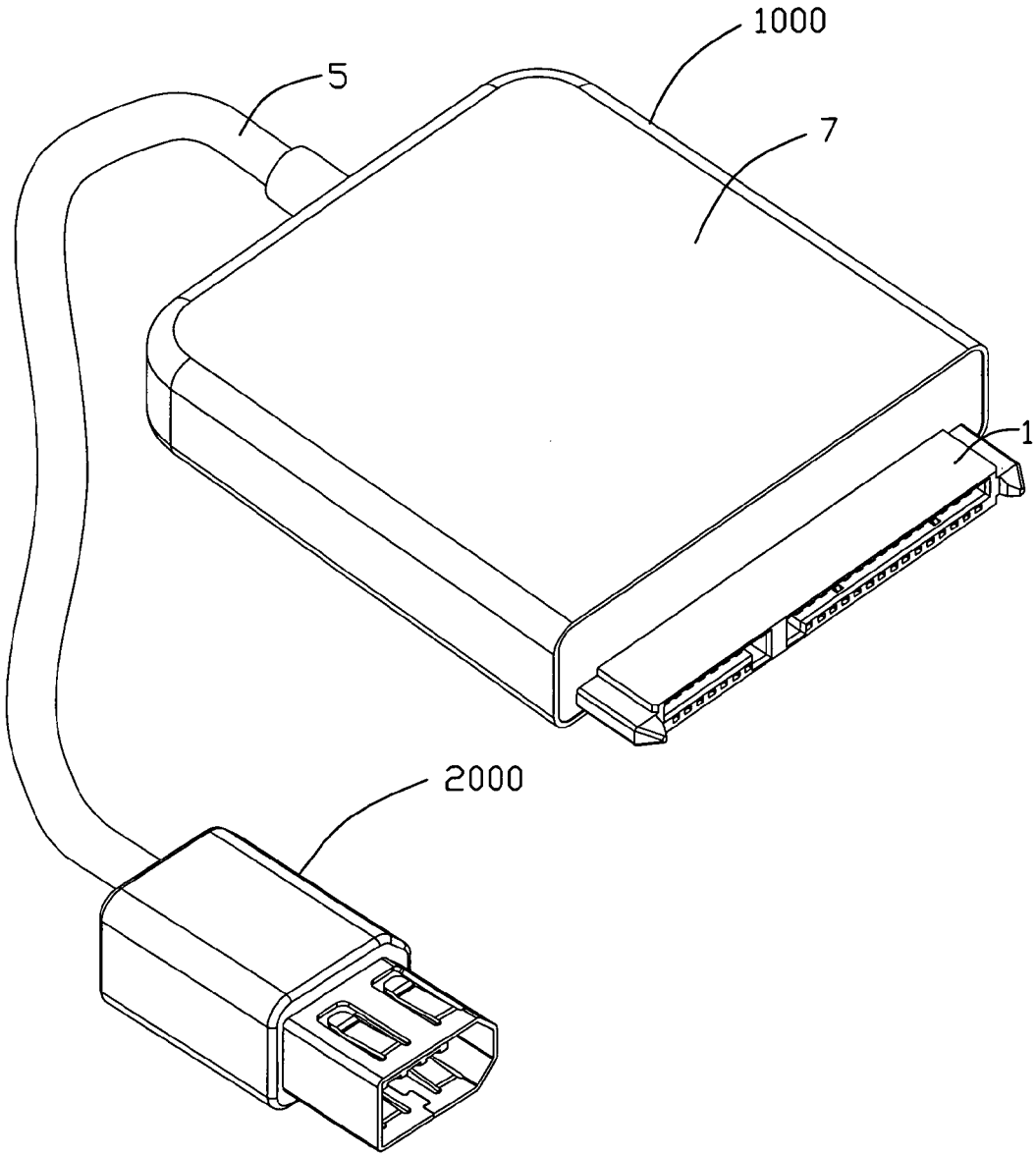
FIG. 8 shows the first connector assembly interconnects with a second connector of a cable assembly in accordance with the present invention.
Figure 9:
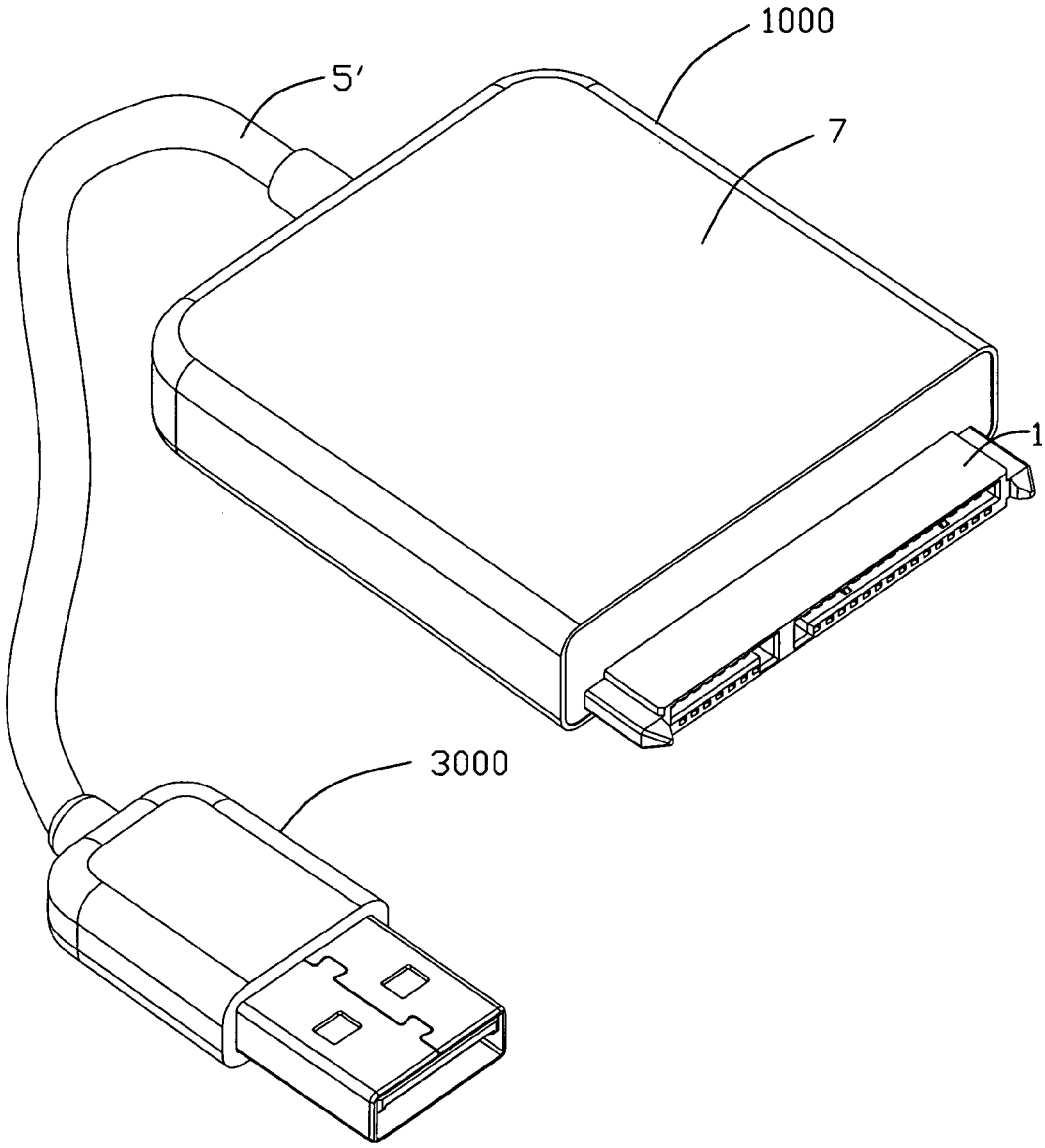
FIG. 9 shows the first connector assembly interconnects with a third connector of a cable assembly in accordance with the present invention.

Referring to FIGS. 8-9, a cable assembly in accordance with the present invention comprises a first connector assembly 1000 optionally interconnects with a second connector 2000 or third connector 3000. In the exemplary embodiment, the first connector assembly 1000 is adapted for Serial Advanced Technology Attachment (SATA) protocol, while the second connector 2000 adapted for IEEE 1394 protocol and the third connector 3000 is adapted for Universal Serial Bus (USB) protocol.

Referring to FIGS. 1-7, the first connector assembly 1000 comprises a first connector 1, a printed circuit board (PCB) 2, a metallic shell 300, a cable 5, a strain relief member 6 and a cover 7.

The first connector 1 includes an elongated insulated housing 10 has a plurality of walls (not numbered) corporately forming a receiving space (not numbered) therebetween. The receiving space is divided into two chambers 102, 104 by a spacer 101. Both the chambers 102, 104 are L-shaped viewed from a front side. A flange portion 12 is attached to a rear edge of the insulated housing 10 and extends beyond an upper surface of the insulated housing 10. A pair of guiding posts 106 are adjacent to lateral sides of the insulated housing 10 and extend forwardly from a front surface of the flange portion 12. A pair of arms 14 extend rearward from lateral sides of a back surface of the flange portion 12. Each arm 14 has a groove 142 defined in a lower section of an inner side thereof. A first positioning cavity 144 is recessed upwardly from a bottom surface and proximate to free end of each arm 14. While a second positioning cavity 146 is recessed inwardly from outer surface of the arm 14 and adjacent to the back surface of the flange portion 12.

The PCB 2 includes a circuit substrate 20, with a set of conductive traces 220 arranged on a front portion 22 thereof. Two first positioning holes 222 are respectively located in lateral sides of a front segment of the PCB 2 and disposed behind the set of conductive traces 220. A cutout 241 is defined in a middle section of a rear portion 24 of the printed circuit board. Four holes 242 are separated into two rows and arranged along lateral sides of the cutout 241. Two second positioning holes 244 are defined in the rear portion of the PCB 2 and disposed outside of the holes 242. A plurality of conductive holes 240 arranged on the rear portion 24 separated into two groups and symmetrically disposed aside of the second positioning holes 244. A group of grounding pads 246 is disposed on the rear portion 24, in front of the cutout 241.

The metallic shell 300 includes a first shielding part 3 and a second shielding part 4.

The first shielding part 3 has a top wall 32, two vertical walls 34, 36 extending downwardly from lateral edges of the top wall 32, a rear wall 38 extending downwardly from an end edge of the top wall 32 and a front wall 37 extending downwardly from a front edge of the top wall 32 to together form a first receiving space 30. The front wall 37 further defines two outlets 370 in lateral sides thereof. A pair of first positioning members 322 protrude into the receiving space 30 from lateral sides of the top wall 32 and are proximate to the outlets 370. Two second positioning members 342, 362 respectively extend into the receiving space 30 from front portions of the two vertical walls 34, 36 and are adjacent to the outlets 370 too. A row of first arch-shaped stoppers 324 extend upwardly from front portion of the top wall 32. Two first holes 344, 364 are defined in front segment of the vertical walls 34, 36, while another two second holes 348, 368 are defined in a rear segment of the vertical walls 34, 36. Two L-shaped first stumps 346, 366 extend into the first receiving space 30 from the two vertical walls 34, 36 and located behind the first holes 344, 364. A first semi-circular shaped outlet 382 is defined in a middle section of the rear wall 38. Another pair of L-shaped second stumps 384 extend into the first receiving space 30 from the rear wall 38 and are disposed at lateral side of the outlet 382.

The second shielding part 4 is similar to the first shielding part 3 and also has a bottom wall 42, two vertical walls 44, 46 extending upwardly from lateral edges of the bottom wall 42, a rear wall 48 extending upwardly from an end edge of the bottom wall 42 to together form a second receiving space 40. A row of second arch stoppers 424 extend downwardly from front portion of the bottom wall 42. A pair of third arch stoppers 442, 462 extend outward from a front portion of the vertical walls 44, 46. Two first tabs 444, 464 extend into the second receiving space 40 from front segment of the vertical walls 44, 46, while another two second tabs 448, 468 extend into the second receiving space 40 from rear segment of the vertical walls 44, 46. A second semi-circular shaped outlet 482 is defined in a middle section of the rear wall 48.

The cable 5 includes a plurality of wires 50, a metallic braiding portion 52 enclosing the wires 50, and a jacket 54 shielding the metallic braiding portion 52. The metallic braiding portion 52 and the jacket 54 of a front portion of the cable 5 are removed away, with the wires 50 exposed outside and separated into two groups, and each group has three individual wires 50. The strain relief member 6 has a body portion 60 molded over the front portion of the cable 5, with partial of metallic braiding portion 52 exposed outside. The strain relief member 6 has substantially T-shaped aligning member 62 in the front of body portion 60, with four posts 64 arranged at lateral sides thereof. The aligning member 62 is mounted to the cutout 241 of the PCB 2, with the four posts 64 inserted into the four holes 242 aside the cutout 241, thus the cable 5 is coupled to the PCB 2 reliably. The cover 7 is made of insulated material, such as plastic material, etc. The cover 7 has a hollow portion 70 for accommodating the metallic shell 300 therein entirely.

When assemble, the contacts 100 is inserted into the insulated housing 10 of the first connector 1, with mating portions 101 extending into the receiving space thereof, tail portions 102 disposed outside of a rear surface of the insulated housing 10. Then lateral sides of the front portion of the PCB 2 is inserted into the grooves 142 of the pair of arms 14 of the first connector 1, with the rear portions 102 of the contacts 100 disposed on the conductive traces 220 of the front portion 22 of PCB 2 and soldered thereon.

Secondly, the strain relief member 6 is mounted to the PCB 2 and the wires 51 are inserted into the conductive holes 240 and soldered therein. Thirdly, the first connector 1, the PCB are assembled to the first shielding part 3, with the front wall 37 disposed behind the flange portion 12, the two arms 14 accommodated in a front portion of the first receiving space 30, first positioning members 322 and second positioning members 342, 362 are inserted into the first positioning cavities 144 and the second positioning cavities 146 of the two arms 16; the PCB 2 accommodated in the first receiving space 30, the first stumps 346, 366 inserted into the first positioning holes 222 and soldered therein, the second stumps 384 inserted into the second positioning holes 224 and soldered therein too.

Fourthly, the second shielding part 4 is assembled to the first shielding part 3, with first tabs 444, 464 and second tabs 448, 468 thereof locked into the first holes 344, 364 and second holes 348, 368 of the first shielding part 3, the cable 5 extending outward through the outlets 382, 482 of the rear walls 38, 48. Fifthly, the first shielding part 3 and the second shielding part 4 are inserted into the hollow portion 70 of the cover 7, with the first stoppers 324 of the shielding part 3, the second stoppers 424 and third stoppers 442 of the second shielding part 3 engaging inner sides of the cover 6. Sixthly, the cable 5 is coupled to the second connector 2000.

FIG. 9 illustrates that the first connector assembly 1000 connects to the third connector 3000 via another cable 5'. The cable 5' is similar to the aforementioned cable 5, excepted that only four wires therein and respectively soldered to second conductive holes (not shown) aside the first conductive holes 240, and other same structure is omitted hereby.

In the preferred embodiment, the first connector assembly 1000 is alternatively coupled to the second connector 2000 and the third connector 3000 by selecting different conductive pads of the PCB 2, however, more different conductive pads for more connectors is anticipated by the present invention. Furthermore, the PCB 2 can be connected to different connectors, optionally, which may be convenient for producers, and the cost of the production is decreased.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

a connector including an insulated housing and a plurality of contacts received therein;

a printed circuit board having a front portion and an opposite rear portion, with the front portion thereof connected to the connector;

a cable coupled to the rear portion of the printed circuit board;

a metallic shell fastened to the printed circuit board; and a cover having a hollow portion, with the metallic shell entirely received therein; wherein the metallic shell has a number of walls together defining a receiving space therebetween to receive the printed circuit board therein; wherein the metal shell has a plurality of stumps extending into the receiving space and are inserted into positioning holes of the printed circuit board; wherein the stumps are soldered in the positioning holes of the printed circuit board; wherein the connector has a pair of arms extending rearward from a back surface of the insulated housing; wherein each arm has a groove receiving a lateral side of the front portion of the printed circuit board; wherein each arm has at least two positioning cavities located in a lower surface and an outer surface thereof, with positioning members of the metallic shell inserted therein; wherein tail portions of the contacts extend beyond a rear surface of the insulated housing and are soldered to conductive traces arranged on the front portion of the printed circuit board; wherein a stain relief member is molded over a front portion of the cable and fastened to the rear portion of the printed circuit board.

2. The cable assembly as recited in claim 1, wherein wires of the cable are inserted into conductive holes of the rear portion of the printed circuit board and soldered therein.

3. The cable assembly as recited in claim 1, wherein a metallic braiding portion of the cable is soldered to corresponding grounding pad arranged on the rear portion of the printed circuit board.

4. A cable assembly, comprising:

a connector adapted for coupling to a cable via a printed circuit board, said printed circuit board having a front portion connected to the connector and an opposite rear portion for coupling to the cable;

a metallic shell having a first shielding part and a second shielding part, said printed circuit board linked with the first shielding part, the second shielding part covering the first shielding part; and a cover enclosing the first shielding part and the second shielding part; wherein the connector has an insulated housing, with a flange portion attached to a rear surface of the insulated housing; wherein the first shield part has a front wall located behind the flange portion; wherein a pair of guiding post arranged lateral sides of the insulated housing and extending forward from front surface of the flange portion; wherein a pair of arms extend rearward from lateral sides of a back surface of the flange portion, wherein the first shielding part latches with the pair of arms.

5. The cable assembly as recited in claim 4, wherein the first shielding part latches with the second shielding part.

* * * * *